US005836373A

United States Patent [19]

Hansen et al.

[11] Patent Number: 5,836,373

[45] Date of Patent: Nov. 17, 1998

[54] STRING MOULD PLANT INCLUDING ARRANGEMENT FOR PREVENTING SHRINKAGE VOIDS IN METAL CASTINGS

[75] Inventors: Preben N. Hansen, Ålsgårde; Steen Pedersen, Ballerup; Niels W. Rasmussen, Frederiksberg; Vagn Mogensen, Gentofte; Emil Jespersen, Glostrup, all of Denmark

[73] Assignee: Georg Fischer Disa A/S, Herlev, Denmark

[21] Appl. No.: 663,253

[22] PCT Filed: Jun. 7, 1994

[86] PCT No.: PCT/DK94/00221

§ 371 Date: Jun. 13, 1996

§ 102(e) Date: Jun. 13, 1996

[87] PCT Pub. No.: WO95/18689

PCT Pub. Date: Jul. 13, 1995

[30] Foreign Application Priority Data

Jan. 3, 1994 [DK] Denmark ..... 0016/94

[51] Int. Cl.[6] ..... B22C 9/08; B22D 27/09; B22D 47/02

[52] U.S. Cl. ..... 164/167; 164/323; 164/337; 164/363

[58] Field of Search ..... 164/323, 337, 164/359, 360, 363, 130, 133, 136, 167

[56] References Cited

U.S. PATENT DOCUMENTS

| | | | |
|---|---|---|---|
| 2,568,428 | 9/1951 | Billiar . | |
| 3,566,952 | 3/1971 | Lane . | |
| 3,905,419 | 9/1975 | Tenner | 164/359 X |
| 4,436,140 | 3/1984 | Ebisawa et al. . | |

FOREIGN PATENT DOCUMENTS

| | | | |
|---|---|---|---|
| 1312391 | 11/1962 | France . | |
| 2437435 | 3/1975 | Germany . | |
| 3-124359 | 5/1991 | Japan | 164/359 |
| 7614080 | 6/1978 | Netherlands . | |
| WO93/11892 | 6/1993 | WIPO . | |
| WO93/22088 | 11/1993 | WIPO . | |

*Primary Examiner*—J. Reed Batten, Jr.
*Attorney, Agent, or Firm*—Larson & Taylor

[57] ABSTRACT

In a string of molds (32) with vertical parting surfaces, each mold cavity (35) is connected through a wide throat with its own after-feeding reservoir (36). When the mold has been poured, a gas pressure is applied through a channel (43) and a passage (41) to a lower metal surface in the after-feeding reservoir (36). This gas pressure is not allowed to exceed the metallostatic pressure in the mold at the surface, at which the pressure is applied, until the metal in the ingate (37) has solidified or the ingate has been blocked in some other way. At the location where the passage (41) opens into the after-feeding reservoir, it is covered by an element (42) that is impermeable to the metal having been poured but permeable to the pressurized gas. When the metal in the ingate (37) has solidified or the ingate has been blocked in some other way, the gas pressure may be increased.

13 Claims, 1 Drawing Sheet

COMPRESSED AIR
A
B
C
25
26
27
28
29
30
31
32
33
34
35
36
37
38
40
41
42
43

STRING MOULD PLANT INCLUDING ARRANGEMENT FOR PREVENTING SHRINKAGE VOIDS IN METAL CASTINGS

TECHNICAL FIELD

The present invention relates to a mould plant which employs moulds having a vertical parting surface or surfaces, and especially those moulds used for pouring light metals from below.

BACKGROUND ART

It is commonly known that metals, both in the liquid and solid state, when cooled undergo a decrease in volume, a so-called thermal contraction. In moulds, in which there is a non-uniform distribution of heat quantity in the mould cavity after the pouring, and in which for this reason not all the parts of the casting solidify at the same time, this causes the regions of the casting remaining longest in the liquid state to give off liquid metal to compensate for the contraction in the regions of the casting having solidified earlier, this leading to flaws in the casting commonly called "shrinkages", either appearing as depressions in the surface of the casting or as hollows (cavities or micro-shrinkages) within the casting. In order to avoid these faults, the skilled person can take a series of steps, of which the most common is the use of after-feeding reservoirs, i.e. cavities in the mould being filled with metal during the pouring operation and having such dimensions that the metal in them remains liquid longer than the last-solidifying regions of the casting, being connected to these regions through passages with a relatively large cross-sectional area so as to enable them to after-feed these regions with liquid metal during their solidification.

Such after-feeding reservoirs are mainly known in two types, viz. as open feeders or risers, i.e. substantially cylindrical cavities extending from the passage connecting them to the casting to the upper surface of the mould, and as internal or enclosed cavities in the mould, so-called "blind risers", placed in the immediate vicinity of the region of the casting to be fed. Relative to the latter form, the former form exhibits the advantage that the higher metallostatic pressure at the after-feeding location, i.e. the pressure of the "head" or overlying metal column, to a high degree supports the after-feeding by pressing the feeding metal through the connecting passage into the casting, while in the latter form, the pressure diminishes during the after-feeding process. On the other hand, the latter form exhibits the advantage of normally giving a higher metal yield in the casting process, i.e. a lesser quantity of metal to be separated from the castings for subsequent re-melting (recycling), this also reducing the energy consumed for melting.

Compared to moulds with a horizontal parting surface, the top surface of moulds with a vertical parting surface has a relatively small surface area, and for this reason, the latter type of moulds allows only to a low degree the use of open feeders or risers for after-feeding purposes, and thus, for this purpose it is generally necessary to use the above-mentioned "blind risers" with the associated disadvantage mentioned above, i.e. the lesser metallostatic pressure for pressing the after-feeding metal in through the passage to the casting. This disadvantage is additionally noticeable when after-feeding light-metal castings, i.e. castings of aluminium and its alloys or magnesium and its alloys, due to the relatively low specific weight of these metals.

In order to overcome the above problem U.S. Pat. No. 2,568,428 discloses blind risers situated on one or both sides of a mould cavity and being at the top connectable to a source or pressurized gas, the pressure whereof will add to the metallostatic pressure at the bottom of the risers and thereby make the after-feeding more efficient.

DISCLOSURE OF THE INVENTION

Casting of light-metal castings in moulds with vertical parting surfaces is of commercial interest especially by casting of moulds in a string-moulding plant, such as e.g. the "Disamatic" mould-making plant and for this reason, the object of the invention is to provide a mould with which it is possible to avoid the disadvantages referred to above, at the same time providing a possibility of increasing the metal yield, i.e. a reduction of the quantity of metal used for pouring the individual moulds.

By maintaining a pressure in the after-feeding reservoir during the solidification of the metal in the mould cavity, said pressure being approximately equal to the metallostatic pressure in the reservoir just after the pouring of the mould, a pressure is created for pressing after-feeding metal in through the passage connecting the after-feeding reservoir to the mould cavity, this latter pressure corresponding to the pressure that could have been achieved by using a corresponding column of metal in a feeder or riser. Thus, when the mould is poured, a quantity of liquid metal corresponding to this metal Column is saved.

It goes without saying that the pressure being applied must not exceed the mean metallostatic pressure in the place where it is applied, until the metal in the ingate associated with the after-feeding reservoir has solidified or this ingate has been blocked in some other manner, e.g. as described in the International Application WO 93/11892, it being obvious that otherwise, a higher applied pressure would force the metal back through the inlet without in any manner contributing to after-feeding the casting. When the metal in the ingate has solidified or the ingate has been blocked, it is possible optionally to increase the pressure being applied, thus increasing the certainty of an effective after-feeding.

The present invention also relates to a pouring and cooling zone and of a special construction exhibiting special features.

BRIEF DESCRIPTION OF THE DRAWINGS

In the following detailed portion of the present description, the invention will be explained in more detail with reference to the drawing, in which.

DESCRIPTION OF THE PREFERRED EMBODIMENTS

Figures 1, 2:
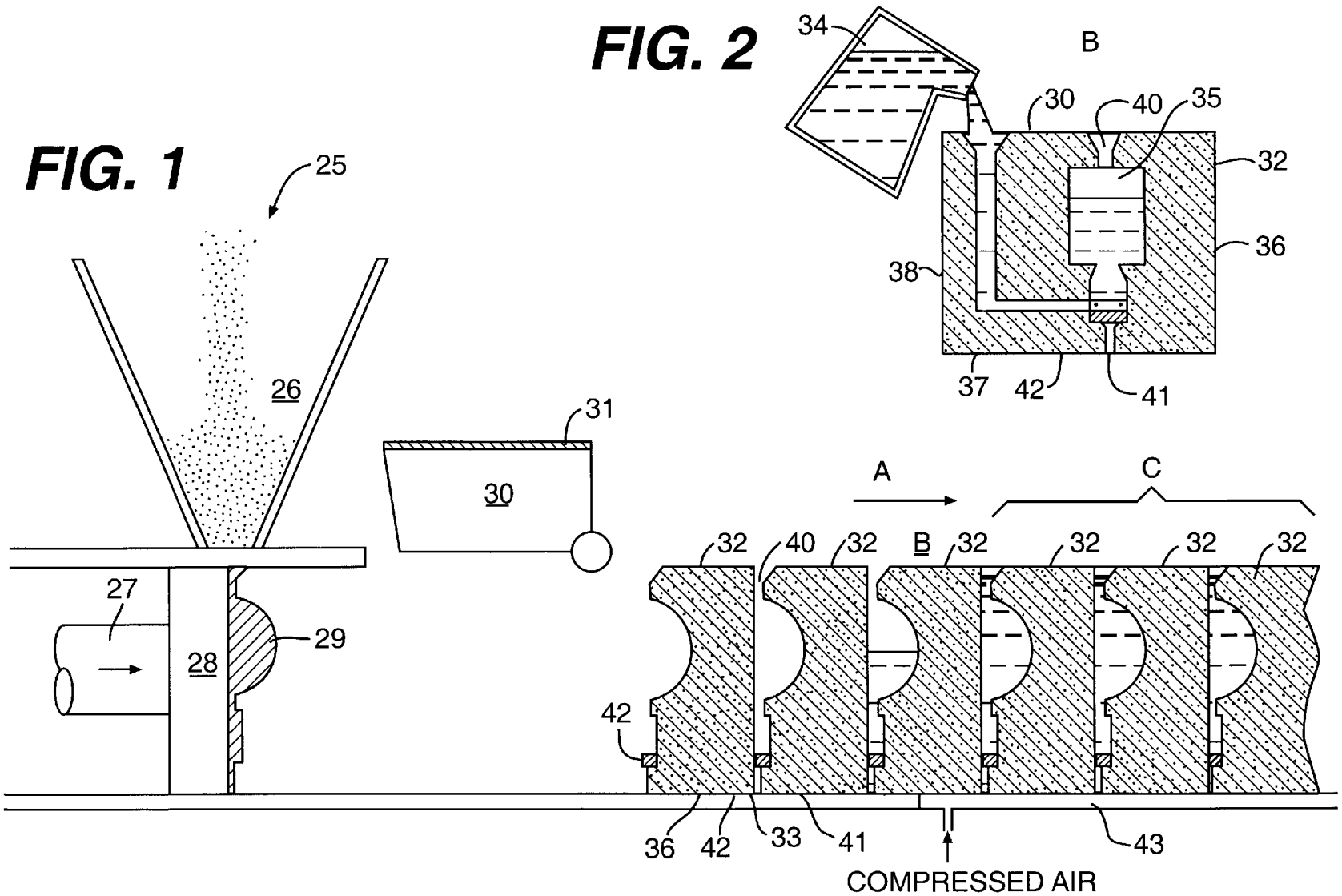
FIG. 1 is a diagrammatic longitudinal sectional view through a part of a string-moulding plant with a moulding machine for making moulds, a string of such moulds produced by the machine, and a part of the pouring and cooling zone of the plant.
FIG. 2 is a cross-sectional view showing the pouring of a mould made up from two of the moulds shown in FIG. 1.

FIG. 1 is a diagrammatic longitudinal sectional view through a string-moulding plant with moulds and a casting and cooling zone according-to the invention. The plant comprises a moulding machine generally designated 25 and of the same kind as the "Disamatic" moulding machine The principles of construction and functioning of this moulding machine, which has been on the market for a number of decades and has found widespread use in foundries throughout the world, should be well known by persons skilled in this art and is described in U.S. Pat. No. 3,008,199, for which reason it will only be described briefly in the present description.

Loose, clay-bonded moulding sand with a moisture content suitable for mould-making is supplied from a supply reservoir 26 to a moulding chamber formed between on the one hand a squeeze plate 28 carrying a pattern 29 and secured to a hydraulic piston 27, and on the other hand an upwardly pivotable counter-pressure plate 30, in FIG. 1 shown in its upwardly pivoted position, likewise having secured to it a pattern 31, here shown as a plane plate. When the squeeze plate 28 is advanced through the moulding chamber by means of the piston 27, the moulding sand will be compacted between the squeeze plate 28 and the downwardly pivoted counter-pressure plate 30, or rather between the patterns 29 and 31 carried thereby, so that a mould consisting of green sand is formed. Then, the counter-pressure plate 30 is moved towards the right in FIG. 1 so that the pattern 31 is loosened from the mould, and pivoted upwardly to the position shown in FIG. 1. After this, the mould 32 is advanced by the piston 27 towards the right in FIG. 1 so as to come into abutment against a previously produced mould 32, after which the piston 27 is withdrawn, freeing the pattern 29 from the mould 32. Thus, the row or string of moulds 32 is advanced stepwise towards the right in FIG. 1 on a suitable support 33 in the direction of the arrow A, the shaped surface facing downstream on a mould 32 cooperating with the shaped surface facing upstream on the previously produced mould 32 in each case forming a mould cavity 35 with associated cavities to be described below.

These moulds are advanced stepwise past a pouring station B, in which the mould cavity is poured with metal by means of a suitable pouring device 34 as shown diagrammatically in cross-section in FIG. 2, after which they are further advanced stepwise through a cooling zone C to a shakeout grille (not shown).

Each of the green-sand moulds formed in this manner comprises a mould cavity 35, the bottom of which is connected through a short and wide passage to a feeding reservoir 36, the latter again being connected to an inlet system consisting of an ingate 37 and a downsprue 38, the latter at the top of the mould opening into a pouring cup 39. In the embodiment of the mould shown, the mould further comprises an open feeder or riser 40 constituting a central connection between the upper part of the mould cavity 35 and the top of the mould.

According to the present invention, a passage 41 communicates the feeding reservoir 36 in the mould with the lower side of the latter, the passage 41 in each mould being obstructed by a separator 42 which is a plate-like element impermeable to molten metal, and which may yield resiliently under gas pressure and be permeable to gas.

According to the present invention, a channel 43 extends from a location immediately downstream of the pouring station B and along at least a part of the cooling zone C in the support 33 below the string of moulds 32, said channel 43 being situated in the support 33 below the passages 41 in the moulds 32. The channel 43 is supplied with compressed air with a pressure not exceeding the metallostatic pressure on the separator 42 in the fully poured mould, said air pressure contributing to feeding the mould cavity 35 from the feeding reservoir 36 by exerting an upwardly directed force on the lower surface of the molten metal in said reservoir 36. The air pressure is being applied in such a way that air bubbles will not ascend through reservoir 36 and the passage into mould cavity 35 and cause a reject casting.

Because in the moulds shown, the open feeder or riser 40 serves for after-feeding an upper region of the mould cavity 35, this feeder or riser 40 may in an automatic pouring device 34 serve an additional purpose, since the presence of metal in the riser 40 indicating complete filling of the mould may be registered by a suitable optical or thermal sensor adapted to produce a signal for the pouring to be terminated.

In the above description, the invention has been explained on the basis of an exemplary embodiment, but it will be understood that the invention may be modified in numerous ways within the scope of the claims set out below. Instead of supplying the pressurized gas from an external source, the gas could optionally be produced in the feeding reservoir by placing therein an agent capable of liberating or developing a gas, or comprising reagents producing a gas by mutual chemical reaction. Likewise, the pouring of the moulds could be carried out otherwise than with the gravity pouring shown, e.g. by pumping the metal from below into the mould and then blocking the inlet as described in the International Patent Application WO 93/11892.

Further, the agent mentioned may comprise additives, partly developing heat by exothermal reaction, partly having suitable heat-insulating properties.

We claim:

1. A string moulding plant comprising a string of sand moulds comprising a plurality of individual mould assemblies, means for moulding sand to produce the moulds of said string of sand moulds, a pouring device for sequentially pouring metal into individual mould assemblies as said mould assemblies are advanced past the pouring device, each of said mould assemblies comprising first and second mutually abutting moulds, at least one mould cavity, an ingate connected to the at least one mould cavity, and an internal after-feeding reservoir disposed below said at least one mould cavity and connected to said at least one mould cavity, and said plant further comprising a source of pressurized gas connected to said after-feeding reservoir.

2. A plant as claimed in claim 1, wherein each of said mould assemblies further comprises a duct of larger cross-sectional area than said ingate connecting said at least one mould cavity to said after-feeding reservoir, said after-feeding reservoir and including a side wall having a lower part connected to said ingate, said mould assemblies each further comprising a passage connected between said after-feeding reservoir and said source of pressurized gas.

3. A plant as claimed in claim 1, wherein each of said mould assemblies further comprises an element impermeable to liquid metal disposed between said reservoir and said passage.

4. A plant as claimed in claim 3, wherein said element yields responsive to gas pressure to permit communication of gas thereby.

5. A plant as claimed in claim 3, wherein said element is gas permeable.

6. A plant as claimed in claim 2, wherein said pouring device is located at a pouring zone, and said plant further comprises a cooling zone at which the mould assemblies are cooled.

7. A plant as claimed in claim 6, further comprising a further duct connected to said source of pressurized gas and extending in a longitudinal direction along the string moulding plant from a location immediately downstream of said pouring device, said further duct abutting against said mould assemblies so as to communicate with a said passage of a said mould assembly as said mould assemblies are advanced.

8. A plant as claimed in claim 7, wherein said further duct comprises at least first and second sections, said first section being disposed closer to said pouring device than said second section and being connected to a first said source of pressurized gas providing a gas pressure no greater than the metallostatic pressure at the bottom of the after-feeding reservoir of mould assemblies which just have been poured, and said second section being connected to a further said source of pressurized gas providing a gas pressure higher than that provided by said first source.

9. A plant as claimed in claim 8, wherein each of said mould assemblies includes a riser connected to said ingate and said first section is of a length in said longitudinal direction that ensures that metal in the ingate and riser of a mould assembly solidifies before that mould assembly exits from said first section.

10. A string mould plant including a pouring zone comprising a pouring device for sequentially pouring metal into an individual mould assembly of a plurality of mould assemblies as said mould assemblies are advanced in sequence past the pouring device, and a cooling zone downstream of the pouring zone at which the mould assemblies are cooled, each of said mould assemblies comprising first and second mutually abutting moulds of green sand, at least one mould cavity, an ingate connected to the at least one mould cavity, an internal after-feeding reservoir, and a first duct of larger cross-sectional area than said ingate connecting said at least one mould cavity to said after-feeding reservoir, said after-feeding reservoir being disposed below said mould cavity and including a sidewall having a lower part connected to said ingate, and each of said mould assemblies further comprising a second duct connected to said after-feeding reservoir and opening at an external surface of said mould assembly, and said plant further comprising a source of pressurized gas adapted to be connected to said second duct.

11. A plant as claimed in claim 10, further comprising a further duct connected to said source of pressurized gas and extending in longitudinal direction along the string moulding plant from a location immediately downstream of said pouring device, said further duct abutting against said mould assemblies so as to communicate with said second duct of said mould assembly as said mould assemblies are advanced.

12. A plant as claimed in claim 10, wherein said further duct comprises at least first and second sections, said first section being disposed closer to said pouring device than said second section and being connected to a first said source of pressurized gas providing a gas pressure no greater than the metallostatic pressure at the bottom of the after-feeding reservoir of mould assemblies which just have been poured, and said second section being connected to a further said source of pressurized gas providing a gas pressure higher than that provided by said first source.

13. A plant as claimed in claim 10, wherein each of said mould assemblies includes a riser connected to said ingate and said first section is of a length in said longitudinal direction that ensures that metal in the ingate and riser of a mould assembly solidifies before that mould assembly exits from said first section.

* * * * *